US006595173B2

(12) United States Patent
Hori

(10) Patent No.: US 6,595,173 B2
(45) Date of Patent: Jul. 22, 2003

(54) VARIABLE VALVE TIMING CONTROLLER

(75) Inventor: Akira Hori, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/261,943

(22) Filed: Oct. 2, 2002

(65) Prior Publication Data

US 2003/0062011 A1 Apr. 3, 2003

(30) Foreign Application Priority Data

Oct. 3, 2001 (JP) ..... 2001-307881

(51) Int. Cl.[7] ..... F01L 1/34

(52) U.S. Cl. ..... 123/90.17; 123/90.15; 123/90.18; 123/90.31

(58) Field of Search ..... 123/90.15–90.18, 123/90.31

(56) References Cited

U.S. PATENT DOCUMENTS 5,832,887 A 11/1998 Adachi et al.
6,269,785 B1 * 8/2001 Adachi ..... 123/90.17
6,394,052 B2 * 5/2002 Miyasaka et al. ..... 123/90.17
6,497,208 B2 * 12/2002 Miyasaka ..... 123/90.17

* cited by examiner

*Primary Examiner*—Thomas Denion
*Assistant Examiner*—Kyle Riddle
(74) *Attorney, Agent, or Firm*—Nixon & Vanderhye P.C.

(57) ABSTRACT

A variable valve timing controller has a housing having a hole in its surface facing a vane rotor. A fitting ring is press-fitted into the hole. A stopper piston prevents relative rotation between the vane rotor and the housing by engaging with the fitting ring. The hole is formed with a part non-contacting with the fitting ring near a through hole, in which a camshaft is inserted, of the housing. Since the fitting ring is apart from the inner surface of the non-contacting part when the fitting ring is press-fitted, little or no stress arises around the non-contacting part near the through hole. Therefore, deformation of the through hole is prevented and sliding friction between the inner periphery of the through hole and the camshaft is minimized.

5 Claims, 4 Drawing Sheets

VARIABLE VALVE TIMING CONTROLLER

CROSS REFERENCE TO RELATED APPLICATION

This application is based on and incorporates herein by reference Japanese Patent Application No. 2001-307881 filed on Oct. 3, 2001.

BACKGROUND OF THE INVENTION

1. Field of the Invention

The present invention relates to a variable valve timing controller that changes opening and closing timing of intake valves and/or exhaust valves of an internal combustion engine according to operating conditions of the engine. The opening and closing timing is referred to as valve timing, and the internal combustion engine is referred to as an engine hereafter.

2. Description of Related Art

Conventionally, a known vane type variable valve timing controller comprises a vane member that rotates with a camshaft, and a housing member that receives driving force from a crankshaft of an engine. In the vane type variable valve timing controller, the vane member is housed in the housing member so that the vane member is capable of rotating relative to the housing member. The variable valve timing controller controls the valve timing of intake valves and/or exhaust valves of the engine by hydraulically controlling a phase of the vane member relative to that of the housing member, a phase difference resulting from a relative rotation between the crankshaft and the camshaft.

A variable valve timing controller disclosed in Japanese Patent Laid-Open Publication No. 10-110603 (corresponding to U.S. Pat. No. 5,832,887) has a stopper piston housed in a vane member and a ring-shaped member press-fitted in a side wall of a housing member. The stopper piston engages with the ring-shaped member to restrain rotation of the vane member relative to the housing member.

The side wall of the housing member is formed with a through hole to receive a sliding member such as a camshaft that is connected with the vane member and rotates relative to the housing member, or a bushing that rotates with the vane member relative to the housing member. The camshaft or the bushing rotates with the vane member in sliding contact with the inner periphery of the through hole formed in the side wall of the housing member.

If the ring-shaped member for engaging with the stopper piston is press-fitted into the side wall of the housing, stress arises in the side wall around the ring-shaped member and the stress transmits to the through hole, causing deformation of the through hole. If the through hole deforms, sliding friction between the inner periphery of the through hole and the camshaft or the bushing increases. As a result, smoothness of the relative rotation between the housing member and the vane member is deteriorated.

SUMMARY OF THE INVENTION

It is therefore an object of the present invention to provide a variable valve timing controller that attains smooth relative rotation between a housing member and a vane member.

According to an aspect of the present invention, a variable valve timing controller is formed with a hole in a side wall of a housing member, wherein a restraining member for receiving a movable member is press-fitted into the hole.

The valve timing controller is also formed with a through hole in the center of the side wall of the housing member.

The hole in which the restraining member is press-fitted is formed with a part non-contacting with the restraining member in a state in which the restraining member is press-fitted into the hole. The non-contacting part is a recess extending in an axial direction and is located near the through hole. The restraining member is apart from the inner surface of the hole where the non-contacting part is formed when the restraining member is press-fitted into the hole. Therefore, development of stress at the hole around the non-contacting part, a portion of the hole near the through hole, is minimized when the restraining member is press-fitted into the hole, and deformation of the through hole is inhibited. Accordingly, sliding friction between the inner periphery of the through hole and a sliding member that rotates in sliding contact with the through hole is minimized, and the sliding member smoothly rotates in the side wall of the housing member. As a result, relative rotation between the housing member and the vane member is retained smooth.

According to another aspect of the present invention, a non-contacting part formed in a hole into which a restraining member is press-fitted provides a fluid passage that delivers fluid to apply hydraulic pressure to the movable member in a direction to disengage the movable member from the restraining member.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE REFERRED EMBODIMENTS

The present invention will be described in detail with reference to various embodiments, throughout which the same or similar parts are denoted by the same or similar numerals.

First Embodiment

FIGS. 1A through 3 show the first embodiment of the present invention. The variable valve timing controller 1 according to the first embodiment controls the valve timing of intake valves by hydraulic pressure.

Figure 2:
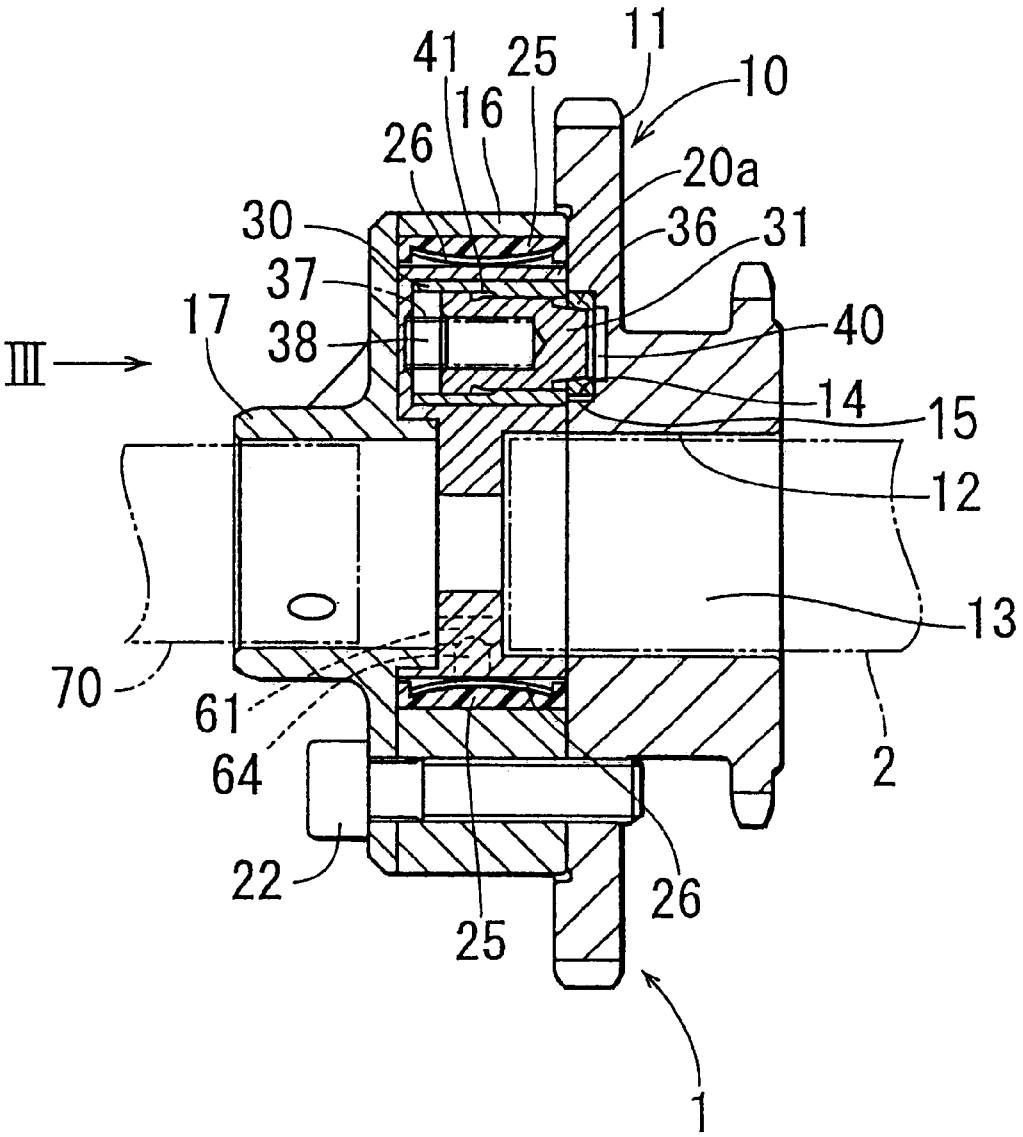
FIG. 2 is a schematic longitudinal sectional view showing the variable valve timing controller according to the first embodiment of the present invention.

As shown in FIG. 2, the variable valve timing controller 1 has a housing member 10, a rotational body in a driving side, that comprises a chain sprocket 11, a peripheral wall 16 and a front plate 17. The chain sprocket 11, the peripheral wall 16 and the front plate 17 are fixed to each other coaxially by bolts 22. The chain sprocket 11 and the front plate 17 are side walls of the housing member 10. The chain sprocket 11 is chained with a crankshaft, a driving shaft of an engine, to receive a driving force from the crankshaft, rotating with the crankshaft in phase. A camshaft 2, a driven shaft, receives the driving force from the crankshaft through the variable valve timing controller 1 and drives intake valves to open and to close. The camshaft 2 is capable of rotating with a predetermined phase difference relative to the housing member 10. The housing member 10 and the camshaft 2 rotate clockwise when viewed from the direction of the arrow mark III in FIG. 2, and the direction of the rotation is referred to as an advance direction hereafter.

Figure 3:
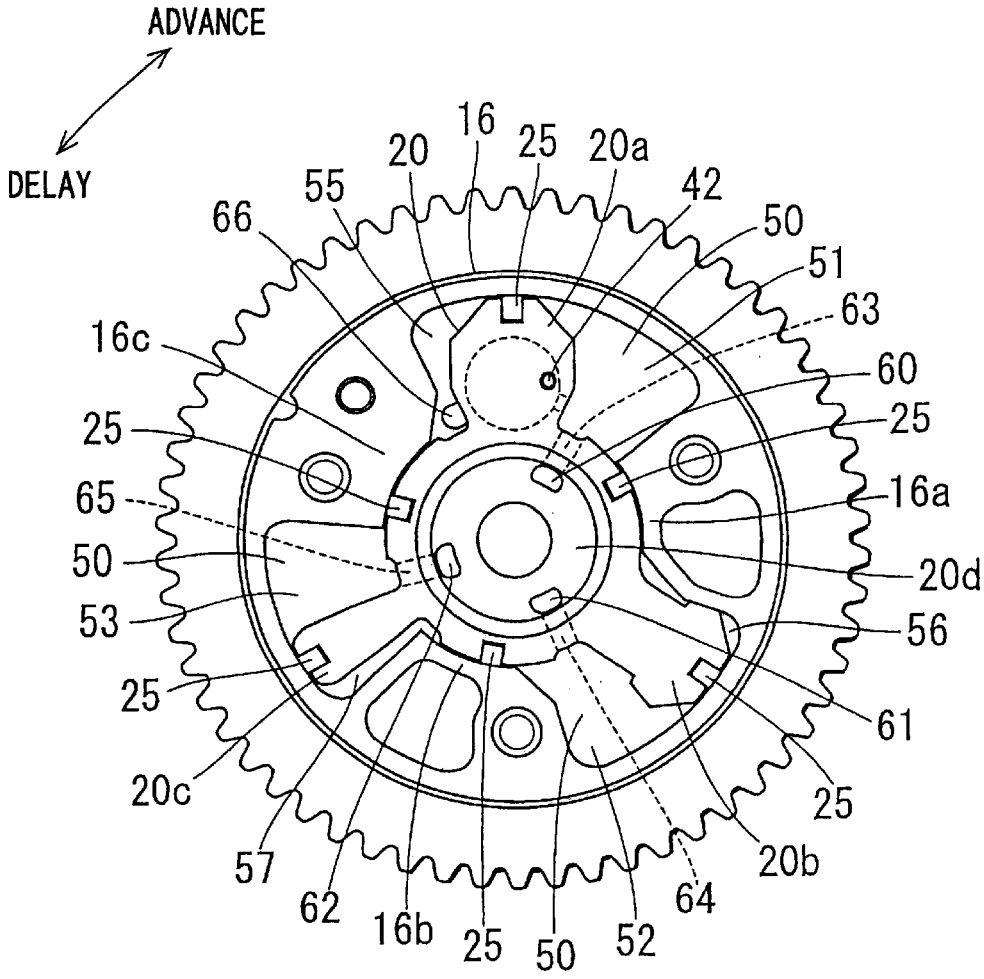
FIG. 3 is a schematic view showing a variable valve timing controller without a front plate viewed from the direction of an arrow mark III in FIG. 2 according to the first embodiment of the present invention.

As shown in FIG. 3, the peripheral wall 16 of the housing member 10 has shoes 16*a*, 16*b*, 16*c* that are formed as dividing parts in the shape of trapezoids, and are disposed circumferentially at generally equal angular intervals. The inner peripheries of the shoes 16*a*, 16*b*, 16*c* have arc-shaped cross-sections perpendicular to the direction of the rotational axis. The shoes 16*a*, 16*b*, 16*c* provide three spaces in radial directions in which accommodation chambers 50 are formed in the shape of fans. The accommodation chambers 50 accommodate vanes 20*a*, 20*b*, 20*c* respectively.

A vane rotor 20, a vane member, has a boss 20*d* and the vanes 20*a*, 20*b*, 20*c* radially extending from the outer periphery of the boss 20*d* at generally equal angular intervals in the circumferential direction. The vanes 20*a*, 20*b*, 20*c* are accommodated in the accommodation chambers 50 respectively so that the vanes 20*a*, 20*b*, 20*c* are capable of revolving. The vanes 20*a*, 20*b*, 20*c* divide the accommodation chambers 50 into delaying chambers and advancing chambers respectively. In FIG. 3, a double-headed arrow illustrates the advance direction and the delay direction.

As shown in FIG. 2, the vane rotor 20, a rotational body in a driven side, contacts the end of the camshaft 2 in the direction of the rotational axis, and is integrated with the camshaft 2 by a bolt. The camshaft 2 is inserted in a through hole 13 formed in the chain sprocket 11 in a sliding contact with the inner periphery 12 that provides the through hole 13. The housing member 10 and the vane rotor 20 are capable of rotating relative to each other. Both inner surfaces of the housing member 10 in the axial direction and both outer surfaces of the vane rotor 20 in the axial direction are in sliding contact with each other.

As shown in FIGS. 2 and 3, the housing member 10 and the vane rotor 20 face each other radially and provide clearances therebetween. Seal members 25 are disposed in the clearances provided by the housing member 10 and the vane rotor 20 therebetween. The seal members 25 are fitted in the recesses formed in the vanes 20*a*, 20*b*, 20*c* and the boss 20*d*. The seal members 25 prevent operational fluid from leaking between the hydraulic pressure chambers through clearances provided between the outer periphery of the vane rotor 20 and the inner periphery of the peripheral wall 16. The seal members 25 are biased by leaf springs 26 in the shape of long plates toward the sliding surfaces facing the seal members 25 radially.

Figure 1A:
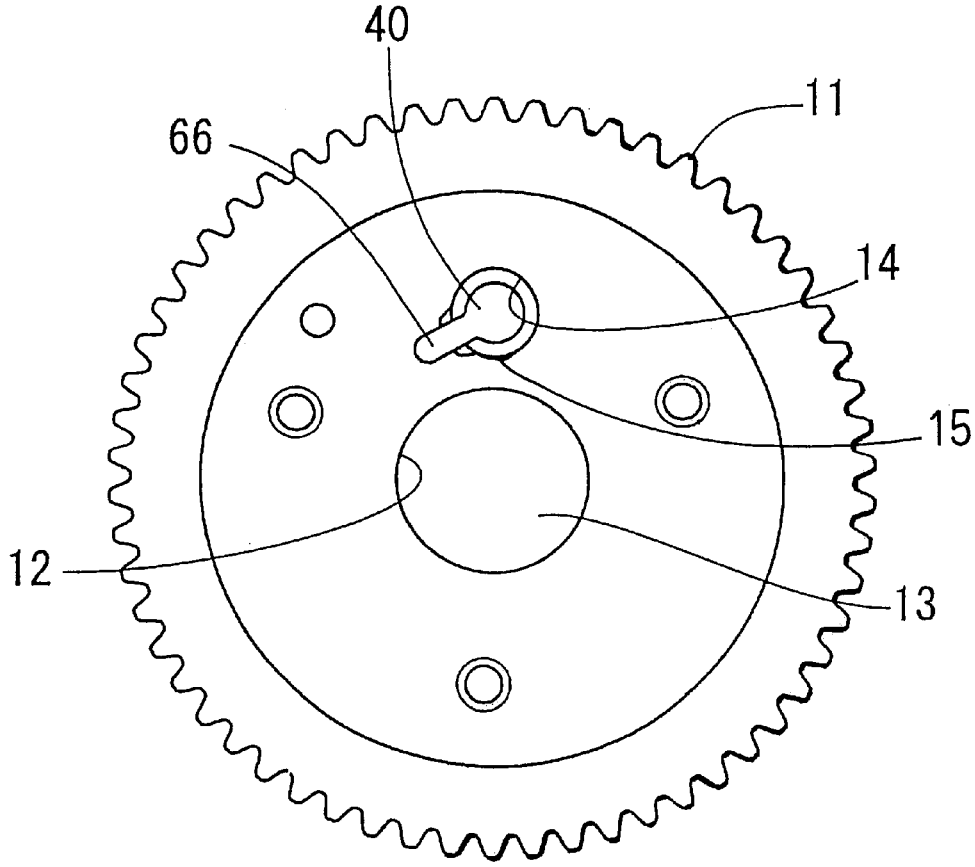
FIG. 1A is a schematic view showing a chain sprocket of a variable valve timing controller viewed from a vane rotor side according to a first embodiment of the present invention.
Figure 1B:
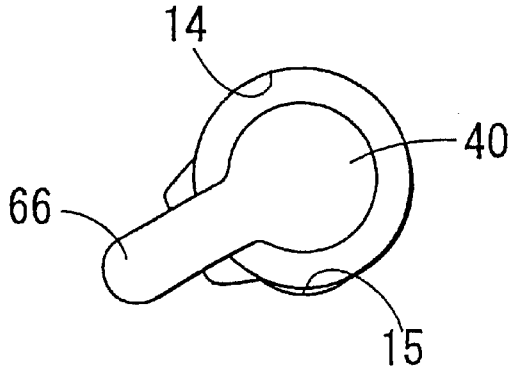
FIG. 1B is an enlarged schematic view showing a hole formed in the chain sprocket according to the first embodiment of the present invention.

As shown in FIG. 2, a cylindrical guide ring 30 is press-fitted into an accommodation recess 38 formed in the vane 20*a*. The guide ring 30 houses the stopper piston 31, a movable member, so that the stopper piston 31 is capable of sliding in the direction of the rotational axis. A fitting ring 36, a restraining member, is press-fitted into a hole 14 formed in an inner surface, which faces the vane rotor 20, of the chain sprocket 11 as shown in FIG. 1.

The hole 14 is formed in the shape of a cylinder. The hole 14 is formed with a part 15 non-contacting with the fitting ring 36 in a state in which the fitting ring 36 is press-fitted into the hole 14. The non-contacting part 15 is formed in the axial direction and is located near the through hole 13. The non-contacting part 15 has a cross-section in the shape of a circular arc. The hole 14 is also formed with a slit that interconnects with the fluid passage 66 through which operational fluid is delivered. The outer surface of the fitting ring 36 contacts the inner surface of the hole 14 except for portions where the non-contacting part 15 and the slit are formed. The outer surface of the fitting ring 36 is apart from the inner surface of the hole 14 at least in the area near the through hole 13. The fitting ring 36 is supported by all or a part of the inner surface of the hole 14 other than a portion near the through hole 13.

As shown in FIG. 2, the stopper piston 31 is capable of engaging with the fitting ring 36. The stopper piston 31 engages with the fitting ring 36 smoothly because both fitting surfaces of the stopper piston 31 and the fitting ring 36 are tapered. A spring 37, a biasing member, biases the stopper piston 31 toward the fitting ring 36.

The operational fluid supplied to hydraulic pressure chambers 40, 41 applies pressure to the stopper piston 31 in a direction to push out the stopper piston 31 from the fitting ring 36. The hydraulic pressure chamber 40 interconnects with an advancing chamber 55 through the fluid passage 66 as shown in FIGS. 1A and 3. The hydraulic pressure chamber 41 interconnects with a delaying chamber 51. The head of the stopper piston 31 is capable of engaging with the fitting ring 36 when the vane rotor 20 is in the most delayed position relative to the housing member 10 as shown in FIG. 3. The vane rotor 20 is incapable of rotating relative to the housing member 10 when the stopper piston 31 is engaged with the fitting ring 36.

When the vane rotor 20 rotates to the advance direction from the most delayed position relative to the housing member 10, the circumferential positions of the stopper piston 31 and the fitting ring 36 deviate from each other and the stopper piston 31 gets incapable of engaging with the fitting ring 36.

An interconnection passage 42 formed in the vane 20*a* shown in FIG. 3 interconnects with another interconnection passage formed in the front plate 17 when the vane rotor 20 is in the most delayed position relative to the housing member 10. The interconnection passage 42 interconnects with the accommodation recess 38, so that the reciprocation of the stopper piston 31 is not interrupted when the stopper piston 31 is in the most delayed position.

As shown in FIG. 3, a delaying chamber 51 is formed between the shoe 16*a* and the vane 20*a*, a delaying chamber 52 is formed between the shoe 16*b* and the vane 20*b*, and a delaying chamber 53 is formed between the shoe 16*c* and the vane 20*c*. Meanwhile, an advancing chamber 55 is formed between the shoe 16*c* and the vane 20*a*, an advancing chamber 56 is formed between the shoe 16*a* and the vane 20*b*, and an advancing chamber 57 is formed between the shoe 16*b* and the vane 20*c*.

As shown in FIG. 2, a passage member 70 is fitted into the front plate 17. The passage member 70 is held by an engine block, not rotatably. Operational fluid is supplied to the delaying chambers and the advancing chambers through the passage member 70.

As shown in FIG. 3, fluid passages 60, 61, 62 are formed in the vane rotor 20 so that the fluid passages 60, 61, 62 pass through the vane rotor 20 axially. Fluid passages 63, 64, 65 are formed radially from the fluid passages 60, 61, 62 respectively, and are interconnected with the delaying chambers 51, 52, 53 respectively.

When operational fluid is supplied to the delaying chambers or the advancing chambers, and is supplied to the hydraulic pressure chamber 41 or the hydraulic pressure chamber 40, the stopper piston 31 receives force leftward in FIG. 2. Accordingly, the stopper piston 31 is pushed out from the fitting ring 36 against the biasing force of the spring 37. As a result, the vane rotor 20 is disengaged from the housing member 10. The vane rotor 20 is rotated relative to the housing member 10 by hydraulic pressures applied to the delaying chambers 51, 52, 53 and the advancing chambers 55, 56, 57. Thus, the phase difference of the camshaft 2 relative to that of the crankshaft is controlled.

In the first embodiment, the chain sprocket 11 is formed with the hole 14 into which the fitting ring 36 is press-fitted. The hole 14 is formed with the non-contacting part 15 that is located near the through hole 13 and has a cross-section in the shape of a circular arc.

When the fitting ring 36 is press-fitted into the hole 14, the outer surface of the fitting ring 36 is apart from the inner surface of the non-contacting part 15, that is, the outer surface of the fitting ring 36 is apart from the inner surface of the hole 14 at least in the area near the through hole 13. Therefore, little or no stress arises at a portion of the hole 14 near the through hole 13 when the fitting ring 36 is press-fitted into the hole 14. Accordingly, deformation of the through hole 13 is prevented. Meanwhile, sliding friction between the inner periphery 12 and the camshaft 2 is prevented, so that the camshaft 2 rotates smoothly in sliding contact with the inner periphery 12 that provides the through hole 13. Thus, the relative rotation between the vane rotor 20 and the housing member 10 is retained smooth.

Second Embodiment

Figure 4:
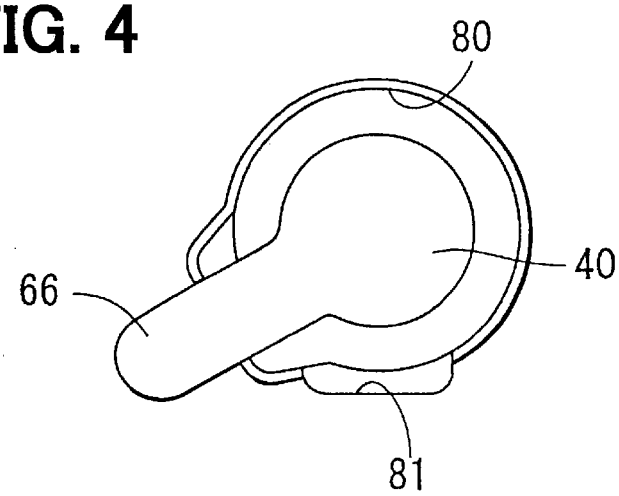
FIG. 4 is a schematic view showing a hole formed in a chain sprocket of a variable valve timing controller according to a second embodiment of the present invention.

FIG. 4 shows the second embodiment of the present invention. As shown in FIG. 4, a hole 80 into which a fitting ring 36 is press-fitted is formed in a chain sprocket 11 of a variable valve timing controller 1. The hole 80 is formed in the shape of a cylinder. The hole 80 is formed with a part 81 non-contacting with a fitting ring 36 in a state in which the fitting ring 36 is press-fitted into the hole 80. The non-contacting part 81 is formed in the axial direction and is located near a through hole 13 formed in the center of the sprocket 11. The hole 80 has a cross-section in the shape of a quadrangle.

When the fitting ring 36 is press-fitted into the hole 80, the outer surface of the fitting ring 36 is apart from the inner surface of the non-contacting part 81, that is, the outer surface of the fitting ring 36 is apart from the inner surface of the hole 80 at least in the area near the through hole 13. Therefore, little or no stress arises at a portion of the hole 80 near the through hole 13 when the fitting ring 36 is press-fitted into the hole 80, likely in the first embodiment. Accordingly, deformation of the through hole 13 is prevented. As a result, the camshaft 2 rotates smoothly in sliding contact with an inner periphery 12 that provides the through hole 13. Thus, the relative rotation between the vane rotor 20 and the housing member 10 is retained smooth.

Third Embodiment

Figure 5:
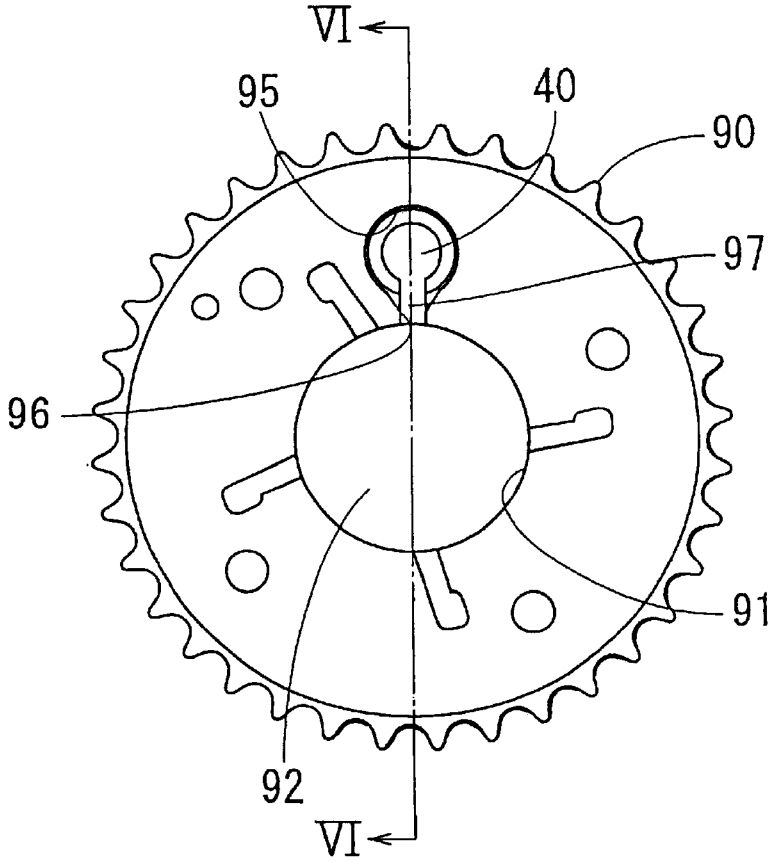
FIG. 5 is a schematic view showing a chain sprocket of a variable valve timing controller viewed from a vane rotor side according to a third embodiment of the present invention.
Figure 6:
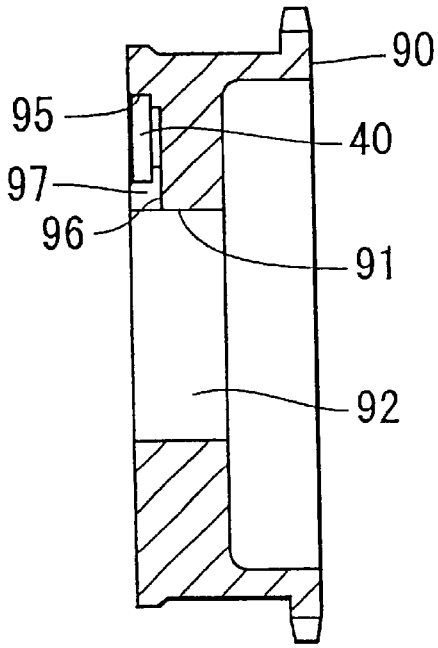
FIG. 6 is a sectional view showing the chain sprocket taken along a line VI—VI in FIG. 5 according to the third embodiment of the present invention.

FIGS. 5 and 6 show the third embodiment of the present invention. As shown in FIGS. 5 and 6, an inner periphery of a chain sprocket 90, a side wall of a housing member of a variable valve timing controller 1, is formed with a through hole 92 into which a camshaft 2 is inserted. The camshaft 2 rotates in sliding contact with the inner periphery 91, which provides the through hole 92, of the chain sprocket 90. A hole 95 into which a fitting ring 36 is press-fitted is formed in the chain sprocket 90. The hole 95 is formed in the shape of a cylinder. The hole 95 is formed with a groove 96, a part non-contacting with the fitting ring 36 in a state in which the fitting ring 36 is press-fitted into the hole 95. The groove 96 is formed in an axial direction and is located near the through hole 92. The groove 96 interconnects with the through hole 92. The outer surface of the fitting ring 36 is apart from the inner surface of the hole 95 where the groove 96 is formed.

The hole 95 interconnects with the through hole 92 through the groove 96. The groove 96 provides a fluid passage 97 to deliver operational fluid to a fluid chamber 40 where hydraulic pressure acts on a stopper piston 31 in the direction to push out the stopper piston 31 from the fitting ring 36.

When the fitting ring 36 is press-fitted into the hole 95, the outer surface of the fitting ring 36 is apart from the inner surface of the groove 96, that is, the outer surface of the fitting ring 36 is apart from the inner surface of the hole 95 at least near the through hole 92. Therefore, little or no stress arises at a portion of the hole 95 near the through hole 92 when the fitting ring 36 is press-fitted into the hole 95. Accordingly, deformation of the through hole 92 is prevented. As a result, the camshaft 2 smoothly rotates in sliding contact with the inner periphery 91 that provides the through hole 92. Thus, the relative rotation between the vane rotor 20 and a housing member 10 is retained smooth.

In the above embodiments, the chain sprocket, a side wall of the housing member of the variable valve timing controller, is formed with the hole into which the fitting ring 36 is press-fitted. Alternatively, the hole may be formed in a front plate that is another side wall of the housing and has a through hole in the center thereof to insert a sliding member such as the passage member 70, which rotates relative to the housing in sliding contact with the front plate according to the first embodiment. In this case too, in order to prevent deformation of the through hole formed in the front plate when press-fitting the fitting ring 36 into the hole, a part non-contacting with the fitting ring 36 should be formed in the inner surface of the hole near the through hole.

In the above embodiments, the variable valve timing controller drives the intake valves. Alternatively, the variable valve timing controller may control the exhaust valves alone, or may control both of the intake valves and the exhaust valves.

In the above embodiments, the chain sprocket transmits the rotating force of the crankshaft to the camshaft. Instead of the chain sprocket, a timing pulley or a timing gear may be applied. Alternatively, the vane may receive the driving force of the crankshaft, a driving shaft, and may rotate the camshaft, a driven shaft, with the housing member.

The present invention should not be limited to the disclosed embodiment, but may be implemented in many other ways without departing from the spirit of the invention.

What is claimed is:

1. A variable valve timing controller for an internal combustion engine, comprising:

a first rotational member connected with a driving shaft of the engine;

a second rotational member that is connected with a driven shaft for driving to open and to close an intake valve and/or an exhaust valve of the engine and rotates with a variable phase difference relative to the first rotational member;

a restraining member press-fitted in a hole formed in one of the first and second rotational members in an axial direction; and a movable member that is accommodated in the other of the first and second rotational members and is capable of moving in the axial direction to engage with the restraining member when the second rotational member is in a predetermined angular position relative to the first rotational member;

wherein the hole is formed with a part non-contacting with the restraining member, the non-contacting part being located near a through hole formed in the center of the rotational member for receiving a sliding member that rotates relative to the rotational member in sliding contact with an inner periphery of the through hole.

2. The variable valve timing controller as in claim 1, wherein:

the restraining member is apart from an inner surface defined by the non-contacting part of the hole and is supported by all or a part of the inner surface defined by the hole other than the non-contacting part.

3. The variable valve timing controller as in claim 2, wherein:

the non-contacting part is a recess extending in the axial direction; and the hole is further formed with a slit interconnecting with a fluid passage that delivers operational fluid to apply pressure to the movable member in a direction to disengage the movable member from the restraining member.

4. The variable valve timing controller as in claim 2, wherein:

the non-contacting part is a groove that extends in the axial direction and interconnects with the through hole, the groove providing a fluid passage that delivers operational fluid to apply pressure to the movable member in a direction to disengage the movable member from the restraining member.

5. The variable valve timing controller as in claim 2, wherein:

one of the first and second rotational members is a housing member formed with an accommodation chamber and the other of the first and second rotational members is a vane member having a vane accommodated in the accommodation chamber, the vane dividing the accommodation chamber into an advancing chamber and a delaying chamber, which are supplied with operational fluid to control the phase difference between the vane member and the housing member.

* * * * *